US007543641B2

(12) United States Patent
Contant

(10) Patent No.: US 7,543,641 B2
(45) Date of Patent: Jun. 9, 2009

(54) SYSTEM AND METHOD FOR CONTROLLING WELLBORE PRESSURE DURING GRAVEL PACKING OPERATIONS

(75) Inventor: Matthe Contant, Eindhoven (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 365 days.

(21) Appl. No.: 11/308,482

(22) Filed: Mar. 29, 2006

(65) Prior Publication Data

US 2007/0227731 A1 Oct. 4, 2007

(51) Int. Cl.
*E21B 43/04* (2006.01)

(52) U.S. Cl. ..... 166/278

(58) Field of Classification Search ..... 166/278, 166/51

See application file for complete search history.

(56) References Cited

U.S. PATENT DOCUMENTS

| | | | | |
|---|---|---|---|---|
| 5,269,376 | A | 12/1993 | Gadelle et al. | |
| 5,435,393 | A | 7/1995 | Brekke et al. | |
| 5,730,223 | A | 3/1998 | Restarick | |
| 5,803,179 | A | 9/1998 | Echols et al. | |
| 5,881,809 | A | 3/1999 | Gillespie et al. | |
| 5,896,928 | A | 4/1999 | Coon | |
| 5,906,238 | A | 5/1999 | Carmody et al. | |
| 6,112,815 | A | 9/2000 | Boe et al. | |
| 6,112,817 | A | 9/2000 | Voll et al. | |
| 6,343,651 | B1 | 2/2002 | Bixenaman | |
| 6,371,210 | B1 | 4/2002 | Bode et al. | |
| 6,533,038 | B2 | 3/2003 | Venning et al. | |
| 6,622,794 | B2 | 9/2003 | Zisk, Jr. | |
| 6,745,843 | B2 | 6/2004 | Johnson et al. | |
| 6,786,285 | B2 | 9/2004 | Johnson et al. | |
| 6,851,560 | B2 | 2/2005 | Reig et al. | |
| 6,857,475 | B2 | 2/2005 | Johnson | |
| 6,883,613 | B2 | 4/2005 | Bode et al. | |
| 6,899,176 | B2 | 5/2005 | Hailey, Jr. et al. | |
| 7,128,152 | B2 * | 10/2006 | Anyan et al. | 166/278 |
| 7,128,160 | B2 * | 10/2006 | Anyan et al. | 166/374 |
| 7,296,624 | B2 * | 11/2007 | Rodet et al. | 166/278 |
| 7,316,272 | B2 * | 1/2008 | Hurst et al. | 166/255.1 |
| 2005/0016730 | A1 * | 1/2005 | McMechan et al. | 166/305.1 |
| 2005/0092488 | A1 | 5/2005 | Rodet et al. | |

FOREIGN PATENT DOCUMENTS

| | | | |
|---|---|---|---|
| GB | 2388858 | A | 11/2003 |
| GB | 2410048 | A | 7/2005 |
| GB | 2410049 | A | 7/2005 |
| WO | 02075110 | A1 | 9/2002 |
| WO | 03023185 | A1 | 3/2003 |
| WO | 2004018839 | A2 | 3/2004 |
| WO | 2004113671 | A1 | 12/2004 |

* cited by examiner

*Primary Examiner*—William P Neuder
(74) *Attorney, Agent, or Firm*—Van Someren, PC; Jeremy P. Welch; James L. Kurka

(57) ABSTRACT

A technique is provided to facilitate gravel packing in a well. A conduit surrounded by a screen is deployed in an isolated lower wellbore region. The conduit cooperates with one or more valves that can be selectively opened to relieve wellbore pressure resulting from advancement of the beta wave during the gravel packing procedure. A control system enables dependable and timely opening of the one or more valves to relieve wellbore pressure and protect the surrounding formation.

32 Claims, 7 Drawing Sheets

SYSTEM AND METHOD FOR CONTROLLING WELLBORE PRESSURE DURING GRAVEL PACKING OPERATIONS

BACKGROUND

Gravel packing is used in wells to control the production of sand and other fines from a surrounding formation. In oil and gas wells, gravel packs have served as an effective way to control the production of these particulates. Gravel is placed in a wellbore around screens or slotted liners, and the screens or liners are sized such that the gravel cannot pass through. A gravel slurry is pumped downhole into an annular region between the wellbore wall and the screen which blocks gravel from moving to the interior of the screen. The slurry carrier fluid, on the other hand, readily passes through the screen and into an open end of an internal wash pipe to be returned up through the wellbore. The gravel particles are sized to prevent sand and other fines from traveling through the gravel pack and entering the screens while allowing formation fluids to freely flow through the gravel pack and into the screens for production.

A problem common to gravel packing horizontal wells is a sudden rise in pressure within the wellbore. During gravel packing, an initial wave of gravel, the "alpha wave", flows to the far end or "toe" of the wellbore. A return wave or "beta wave" carries gravel back up the wellbore from the toe and fills the upper portion of the wellbore left unfilled by the alpha wave. As the beta wave progresses up the wellbore, the pressure in the wellbore increases due to frictional resistance to the flow of carrier fluid. The part of the carrier fluid which is not lost to the formation by leak-off into the formation must flow back to the toe region through the small annular space between the screen and the wash pipe. At the toe region, the return flow of carrier fluid finally enters the open end of the wash pipe. Accordingly, the further the beta wave progresses, the further the carrier fluid must travel to reach the toe region. The increasing distance creates an increasing frictional resistance to the return fluid flow, causing the wellbore pressure to rise.

The increased wellbore pressure can lead to early termination of the gravel pack operation by increasing the risk that the wellbore pressure will rise above the formation fracture pressure. Such increased wellbore pressures can fracture the formation and lead to a bridge at the fracture and thus a poor quality gravel pack. Accordingly, the gravel pack operations typically are terminated before the wellbore pressure approaches formation fracture pressure, or the gravel pack procedures are designed such that the formation fracture pressure will only be reached when the beta wave has carried the gravel pack up through the wellbore over the entire screen region. This, of course, limits the length of the screen region that can be gravel packed in one time.

Attempts have been made to reduce the pressure build up during propagation of the beta wave. For example, valves have been placed along the wash pipe with the intent that the valves will open when wellbore pressure builds to effectively short-circuit or shorten the flow path of the returning carrier fluid. However, existing systems can suffer from lack of immediate or accurate control over the opening of the valves. For example, some systems are actuated from the surface via pressure pulses, which can be undesirably slow in initiating actuation of the valves. Other systems actuate the valves based on threshold pressures, rates of change in pressure or differential pressures. However, relying on threshold pressures requires use of a relatively small pressure window and incurs the risk of valves not opening in the proper sequence.

Similarly, relying on rates of pressure change or differential pressures can lead to inadvertent actuation of the valves due to a variety of downhole events other than pressure increases created by the beta wave.

SUMMARY

In general, the present invention provides a system and method for controlling pressure in a wellbore during a gravel packing procedure. The system and method utilize a conduit, such as a wash pipe, positioned and isolated within a lower wellbore region. The conduit comprises an internal passageway, and one or more valve assemblies are positioned along the conduit to selectively admit fluid from the isolated lower wellbore region into the internal passageway. A unique control system enables the immediate and accurate opening of each valve assembly at a desired time to relieve pressure increase.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for gravel packing an isolated lower wellbore region. The system and methodology enable dependable and predictable control over pressure increases in the wellbore that result from progression of the gravel packing beta wave. For example, the system and methodology facilitate maintenance of the wellbore annulus pressure below the formation fracture pressure on a real-time basis. The pressure control system also is compatible with subsequent fluid pumping or other fluid flow operations that often follow the gravel packing procedure.

Figure 1:
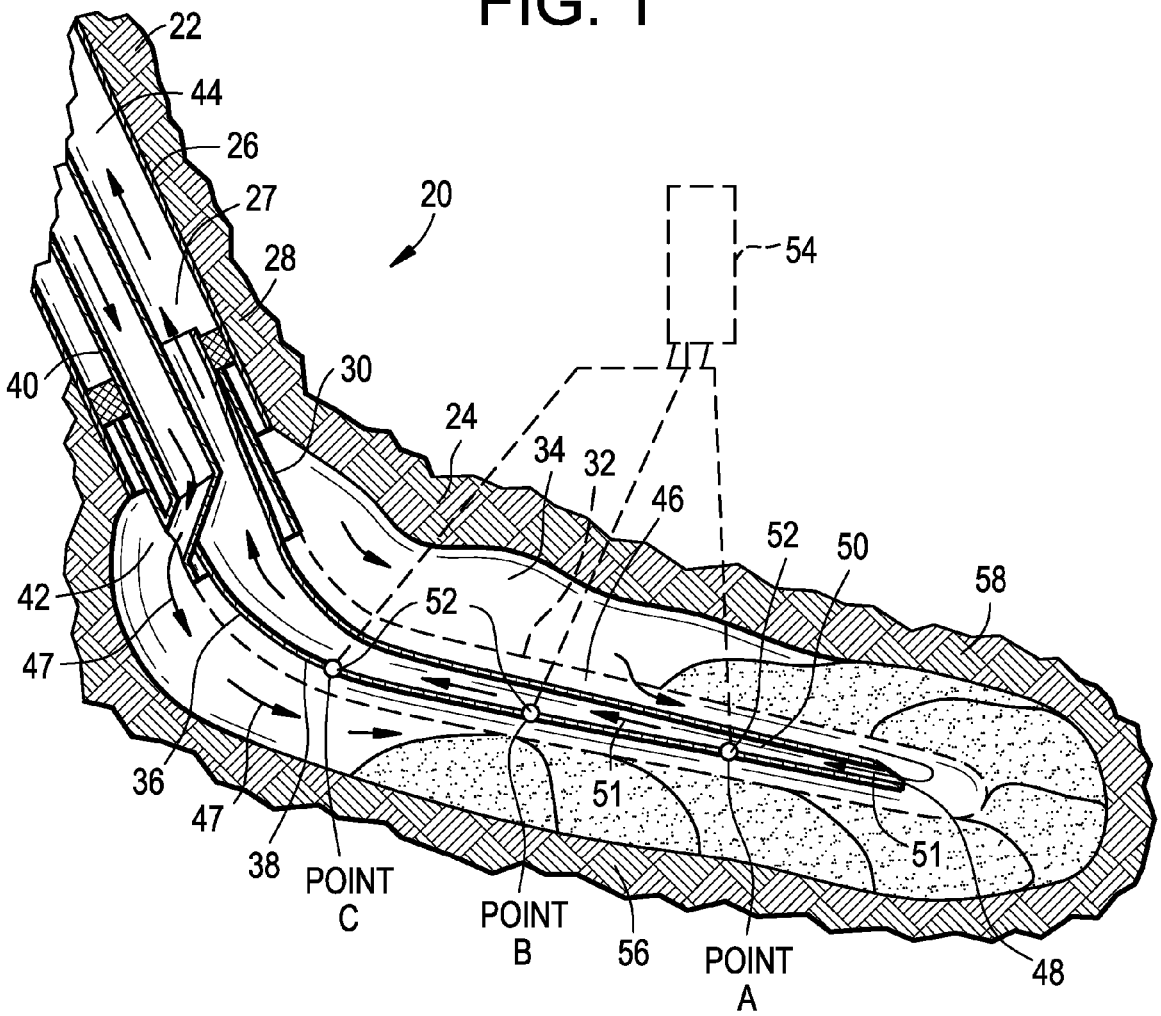
FIG. 1 is a schematic view of a wellbore with a gravel packing system therein, according to an embodiment of the present invention.

Referring generally to FIG. 1, a wellbore 20 is illustrated as having a vertical or slightly deviated upper section 22 and a deviated, e.g. substantially horizontal, lower section 24. Upper section 22 is lined by a casing 26, and lower section 24 is illustrated as an open hole, although casing 26 also can be placed in lower section 24. To the extent casing 26 covers any producing formations, casing 26 is perforated to provide fluid communication between the formations and wellbore 20.

A gravel packing system 27 is deployed in wellbore 20 and comprises a packer 28 which is positioned and set generally near the lower end of upper section 22. Packer 28 is designed to engage and seal against casing 26, as is known in the art. In this embodiment, packer 28 comprises an extension 30 to which other lower completion equipment can be attached. For example, a screen 32 can be attached to extension 30 adjacent, for example, a producing formation. A lower annulus 34 is formed between screen 32 and the wall of wellbore 20.

A gravel packing tool or service tool 36 is deployed in wellbore 20 such that it passes through packer 28 and extends within screen 32. Service tool 36 extends to the "toe" or distal end of lower section 24. Service tool 36 further comprises a conduit 38 that extends from packer 28 to the toe of lower section 24 and is primarily located in an isolated region of the wellbore downhole from packer 28. Service tool 36 also comprises an upper portion 40, such as a tubing, coupled to conduit 38 at a crossover 42. An upper annulus or other flow path 44 is formed above packer 28 between the wall of wellbore 20 and the wall of upper portion 40. Also, an inner annulus or other flow path 46 is formed between the inner surface of screen 32 and conduit 38 within the isolated region of the wellbore.

Crossover 42 allows a gravel slurry 47 to be pumped down through tubing 40 and to emerge into lower annulus 34 below packer 28. Slurry fluids separated from the gravel enter conduit 38 below packer 28, such as through an open end 48 of conduit 38 at the toe of wellbore 20. Those returning slurry fluids are conveyed upwardly through an interior passageway 50 of conduit 38, as indicated by arrows 51. Upon reaching crossover 28, the returning slurry fluids are conveyed through or past packer 28 and into upper annulus/flow path 44, through which the return fluids are conveyed to the surface.

At least one diverter valve assembly, such as pressure release valve assembly 52, is mounted in cooperation with conduit 38 below packer 18. The one or more pressure release valves 52 may be mounted to the wall forming conduit 38 or formed as an integral part of the conduit. However, other structures for employing valve assemblies 52 in cooperation with conduit 38 also can be used. In any event, the valve assembly 52 closes and seals corresponding openings through conduit 38 until wellbore pressure is to be released. At that time, the selected specific valve assembly is opened to short-circuit the flow of return fluids that would otherwise be forced to migrate to open end 48 before returning along interior passage 50. In the embodiment illustrated, gravel packing system 27 comprises a plurality of pressure relief valve assemblies 52, such as the three illustrated valve assemblies, however other numbers of valve assemblies can be utilized depending on the specific application.

Valve assemblies 52 are selectively controlled by a control system 54 which enables the dependable and rapid actuation of individual valve assemblies 52 as desired to relieve pressure buildup in wellbore 20 along conduit 38. As discussed in greater detail below, control system 54 may comprise individual units associated with each pressure relief valve assembly 52, or the control system 54 may comprise valve units that are actuated in response to signals provided from a central control located at the surface or other control location. The pressure build up in wellbore 20 begins after an alpha wave 56 progresses along the lower portion of the isolated wellbore region to the toe of the wellbore and then begins to return along an upper portion of the wellbore as a beta wave 58. The greater the distance over which the beta wave 58 must travel to cover screen 32, the greater the increase in wellbore pressure. Control system 54 in cooperation with valve assemblies 52 can selectively relieve this wellbore pressure to enable progression of the beta wave over greater distances without risking fracture of the surrounding formation.

Figure 2:
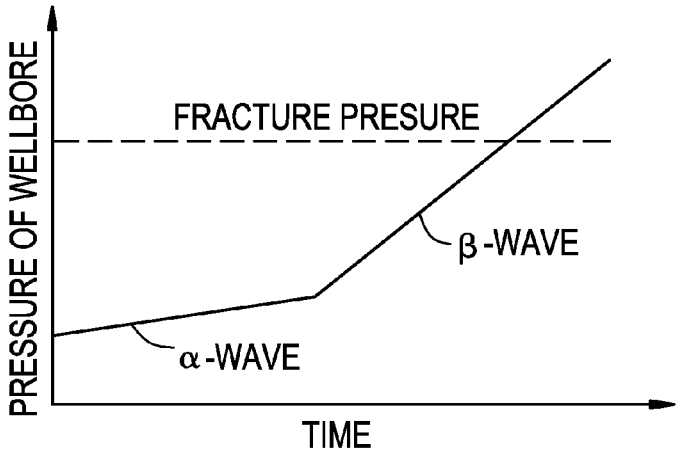
FIG. 2 is a graphical illustration of wellbore pressure as a function of time if the wellbore pressure is not released.

As illustrated graphically in FIG. 2, when no pressure relief is provided, the progression of the beta wave over time can increase the wellbore pressure to a level that crosses the fracture pressure threshold of a given formation. If this occurs, the formation can fracture and create a bridge at the fracture point. Accordingly, pressure relief valve assemblies 52 are used to relieve the wellbore pressure before it crosses the formation fracture pressure threshold.

Figure 3:
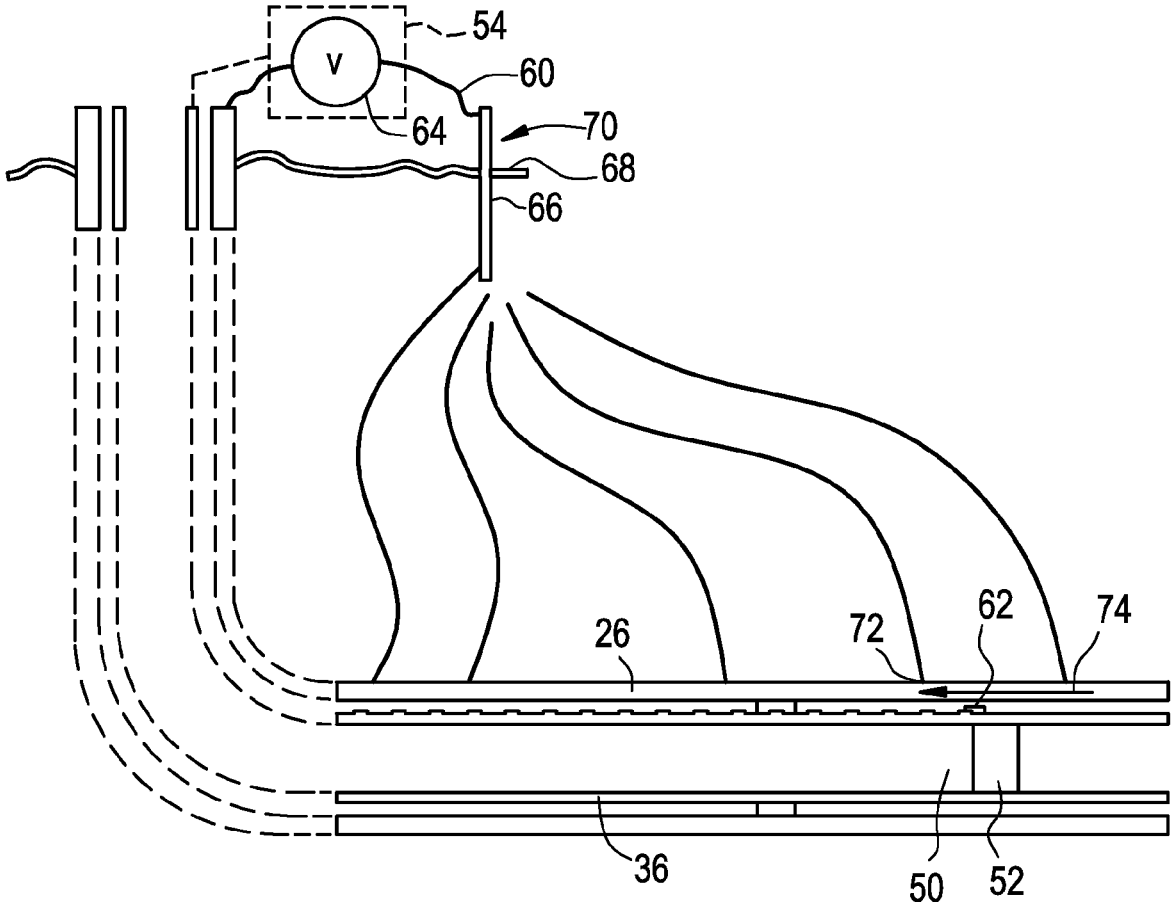
FIG. 3 is a schematic illustration of one embodiment of a control system to control the opening of valves during a gravel packing procedure, according to an embodiment of the present invention.

Referring generally to FIG. 3, one embodiment of control system 54 is illustrated schematically. It should be noted that the following discussion applies regardless of the orientation of the wellbore, and the schematic illustration is intended as representative of horizontal wellbore sections as well as less deviated wellbore sections ranging from vertical to substantially horizontal. In this embodiment, control system 54 comprises an electromagnetic telemetry system 60 that enables instantaneous control over actuation of valve assemblies 52 from a surface location. For example, a wellbore pressure sensor 62 can be located proximate each valve assembly 52 to provide wellbore pressure data to control system 54 via electromagnetic telemetry. Pressure sensor 62 may comprise an array of sensors spaced a certain distance apart, e.g. 5 meters, to measure the pressure profile downhole when the beta wave passes over the valve. When the progression of the beta wave 58 causes the wellbore pressure to increase to a predetermined level or profile, control system 54 is used to send an instantaneous signal via electromagnetic telemetry system 60 to the appropriate valve assembly 52. The signal initiates opening of the valve assembly 52, thereby relieving the wellbore pressure by short circuiting the return path of the slurry fluids.

The electromagnetic telemetry system 60 can be utilized with a variety of gravel packing system configurations, e.g. a multiple valve system deployed in a deviated wellbore as illustrated in FIG. 1. As illustrated, electromagnetic telemetry system 60 comprises a current source 64 that is conductively coupled to a stake 66 positioned in the ground 68 at a surface location 70. The current source 64 also is conductively coupled to a conductive member extending downhole, such as the casing 26 or service tool 36. In the embodiment illustrated, current source 64 is coupled to casing 26, and the current applied by current source 64 through ground 68 is returned through casing 26. The current radiates deep into the earth based on the resistivity of the earth, the deeper it gets, the weaker the current becomes. As long as some current flows in the conductive member, e.g. casing 26, this current then can be measured as a voltage, due to the fact that the conductive member has a certain resistance. Accordingly, a voltage difference can be detected and measured between a first point 72 and a second point 74 along the conductive member and relayed to valve assembly 52. By modulating the current at current source 64, a command can be sent to valve assembly 52, which is measured in the form of a modulated voltage between two points on the conductive member, e.g. casing 26. The modulated current signal can be applied uniquely to individual valve assemblies 52 to provide instantaneous surface control over each individual valve assembly even when a plurality of valve assemblies 52 are used in a given application, as illustrated in FIG. 1. The system works with the current source as well as with a voltage source. Furthermore, the principle of sending information from the downhole tool to surface, e.g. pressure data sent from pressure sensor 62, is the same as described above where information is sent from the surface to the downhole tool. In an alternate embodiment, instead of using stake 66, the current source 64 can apply the current at two points on the conductive member itself, e.g. casing 26, provided the two points are sufficiently spaced from each other.

Figure 4:
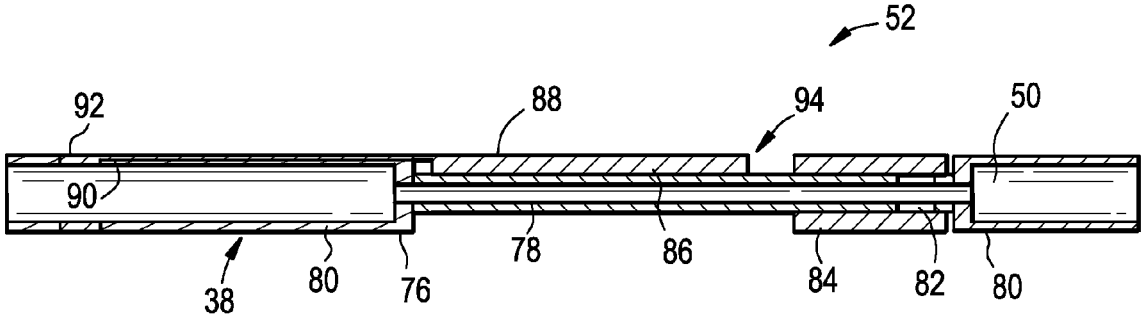
FIG. 4 is a schematic illustration of a section of conduit having a valve for relieving wellbore pressure, according to an embodiment of the present invention.

An example of a valve assembly 52 that can be utilized with electromagnetic telemetry system 60 is illustrated schematically in FIG. 4. In this embodiment, conduit 38 comprises a wash pipe 76 having a narrow diameter section 78 disposed longitudinally between larger diameter sections 80. One or more openings/ports 82 extend through the wall of narrow diameter section 78 for fluid communication with interior passage 50. Valve assembly 52 is coupled to wash pipe 76 to selectively enable flow of fluid from an exterior region surrounding wash pipe 76 into interior passage 50. Valve assembly 52 may comprise, for example, a sliding sleeve valve 84, an actuator 86 for actuated sliding sleeve valve 84, an intelligent electronics section 88 coupled to the actuator 86, an antenna wire 90 coupled to electronics section 88, and an antenna termination 92. The antenna wire 90 and antenna termination 92 are used to measure the voltage difference between two points 72, 74 on the casing or conduit 38. As described in the preceding paragraph, this voltage difference can be manipulated from the surface via electromagnetic waves sent instantaneously through the earth. The electronic section 88 is configured to decode the measured voltage difference signal and, upon receiving the proper predetermined signal, provides an input to actuator 86 which opens sliding sleeve valve 84.

Figure 6:
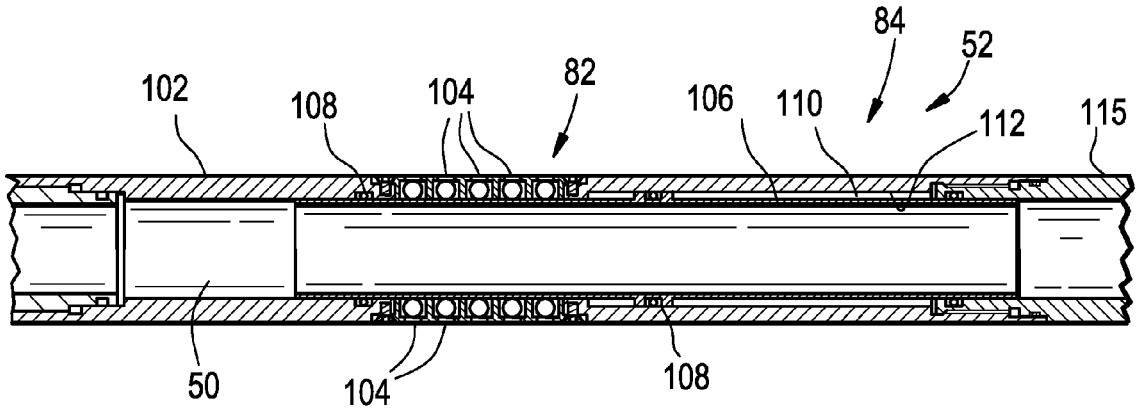
FIG. 6 is a view of a portion of a sliding sleeve valve for use in selectively relieving pressure during gravel packing, according to an embodiment of the present invention.

Many of the valve assembly components can be combined in a unit 94 located within narrow diameter section 78, as further illustrated in FIG. 6. In this example, unit 94 comprises an antenna wire connection 96 to which antenna wire 90 is connected. Antenna wire connection 96 is coupled to electronics section 88 which decodes the electromagnetic signal received through antenna wire connection 96. Upon receipt of the appropriate signal, electronic section 88 causes actuator 86 to open sliding sleeve valve 84. Positioned between antenna wire connection 96 and electronics section 88 is a battery 98 which provides power to run electronics 88. In this embodiment, actuator 86 further comprises a pilot valve 100, e.g. a one shot pilot valve, that can be actuated to initiate the opening of sliding sleeve valve 84. Furthermore, electronic section 88 may be constructed as a micro controller mounted on a printed circuit board.

An embodiment of valve 84 is illustrated in greater detail in FIGS. 6-9 which present sequential portions of a suitable valve 84 usable to selectively open a flow path to the interior passage 50 of conduit 38. Referring initially to FIG. 6, a portion of valve 84 is illustrated in which a valve housing 102 is formed as part of conduit 38. For example, valve housing 102 may be a tubular section integrated into conduit 38. The valve housing 102 comprises opening 82 which is filled with one or more check valves 104 that allow fluid into interior passage 50 from an external environment once port 82 is opened. However, the check valves block outward flow of fluid from the interior passage 50. In the example illustrated, the one or more check valves 104 comprise a plurality of check valves.

When valve 84 is in the closed position, a valve mandrel 106 blocks any flow through opening 82. The valve mandrel 106 is slidably sealed within valve housing 102 via one or more seal members 108. Furthermore, the valve mandrel 106 may be designed such that hydrostatic pressure in the well acts on the mandrel to naturally bias the mandrel toward an open position that would allow fluid flow through opening 82 into interior passage 50. However, movement to this open position is blocked by a fluid 110, such as a hydraulic oil, disposed in a chamber 112 that prevents any movement of valve mandrel 106 toward the open position. Chamber 112 is in fluid communication with a flow port 114 extending through a ported sub 115, as illustrated in FIG. 7.

Figure 7:
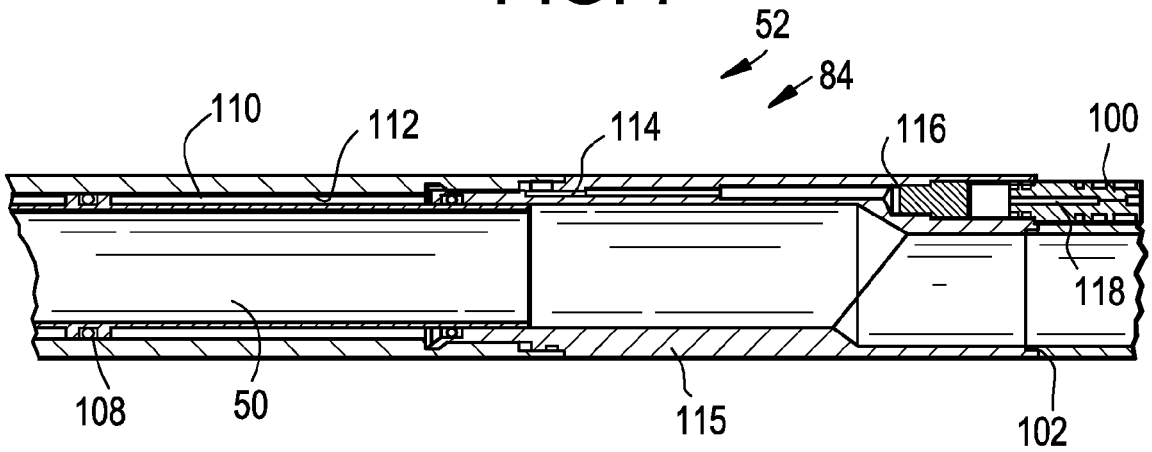
FIG. 7 is a view similar to that in FIG. 6, but showing another portion of the sliding sleeve valve, according to an embodiment of the present invention.
Figure 8:
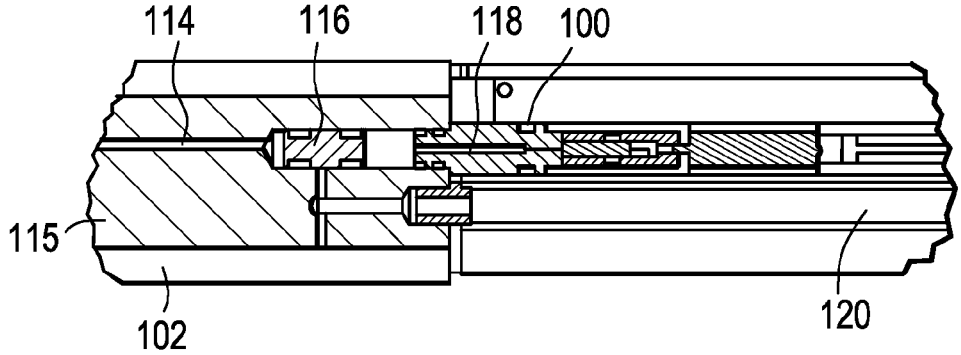
FIG. 8 is a view similar to that in FIG. 6, but showing another portion of the sliding sleeve valve, according to an embodiment of the present invention.

Upon receiving the appropriate electromagnetic command signal from the surface, electronic section 88 activates one shot pilot valve 100, as further illustrated in FIG. 7. In the specific example illustrated, pilot valve 100 cooperates with a second pilot valve 116 which acts to trap a hydraulic fluid between the valve bodies of pilot valve 100 and pilot valve 116. When the electronic section 88 decodes the appropriate electromagnetic signal, electronics section 88 opens valve 100 to bleed the hydraulic oil, trapped between pilot valve 100 and pilot valve 116, through port 118. As the trapped hydraulic fluid is bled from between pilot valves 100, 116, the body of pilot valve 116 shifts to the right (as illustrated in FIG. 7) and opens flow port 114 such that hydraulic fluid 110 can flow from chamber 112 through flow port 114 and into an atmospheric chamber 120, as illustrated in FIG. 8. As the hydraulic fluid 110 bleeds into atmospheric chamber 120, hydrostatic pressure acts on valve mandrel 106 and moves the valve mandrel to uncover opening 82 and check valves 104. At this point, fluid flow from the exterior of the valve to the interior passage 50 is allowed.

Figure 9:
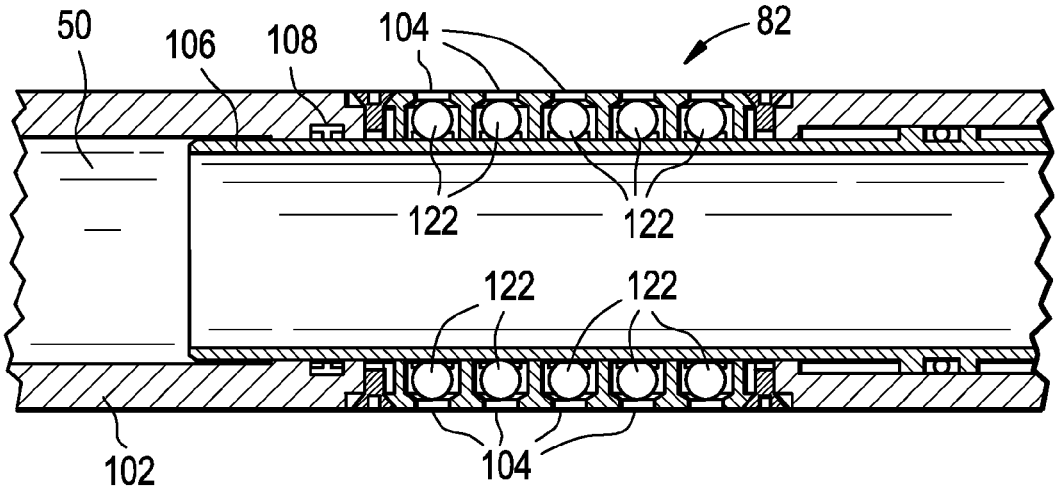
FIG. 9 is a view similar to that in FIG. 6, but showing another portion of the sliding sleeve valve, according to an embodiment of the present invention.

Upon completing certain types of gravel pack operations, subsequent operations require that ports 82 remained closed. This might be necessary, for example, to apply treatment fluid through a far end of the wash pipe without creating flow paths at the valve locations. Accordingly, one-way check valves 104 can be deployed in openings 82 to block any outward flow from interior passage 50. In one embodiment, as illustrated in FIG. 9, the check valves 104 are ball-type check valves that each utilize a ball 122 which can be unseated to allow flow from the exterior into interior passage 50. However, the balls 122 move to block outward flow of fluid from interior passage 50 even when valve mandrel 106 has been moved to an open position.

Figure 10:
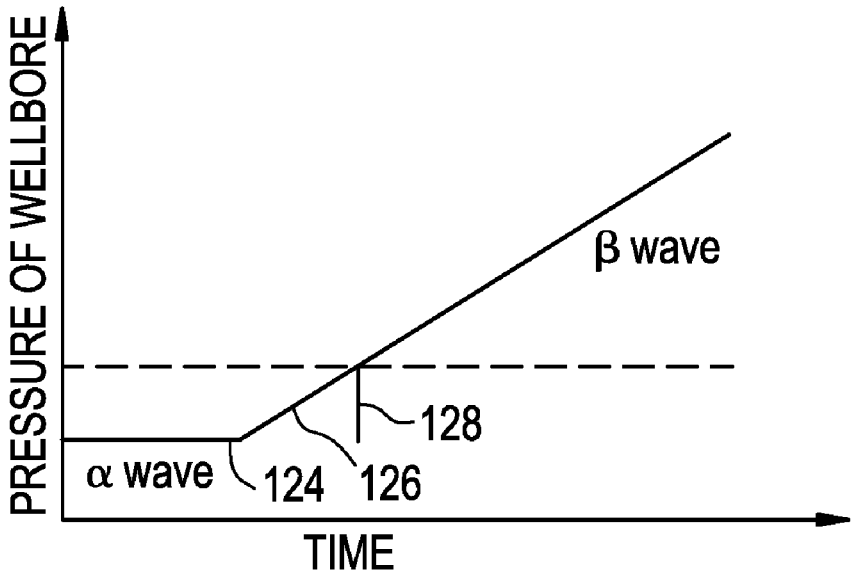
FIG. 10 is a graphical illustration of wellbore pressure as a function of time when a first pressure relief valve is opened, according to an embodiment of the present invention.

The operation of gravel packing system 27 can further be described with reference FIGS. 10-12. As the gravel slurry is moved downhole during a gravel packing operation, the alpha wave 56 moves along conduit 38 while wellbore pressure remains substantially constant, as indicated by segment 124 of the graph illustrated in FIG. 10. After the bottom part of the wellbore has been filled with gravel, the beta wave 58 returns from the toe of the wellbore. The further the beta wave moves away from the toe of the wellbore, the greater the pressure, as illustrated by the rising pressure segment 126. Once the wellbore pressure rises to a point at or near the fracture pressure of the formation, the first valve assembly 52, i.e. the valve assembly 52 closest to the toe of the wellbore (see point A in FIG. 1), is actuated. In other words, an appropriate signal is provided to the valve assembly 52 to cause the movement of valve mandrel 106 and the opening of port 82. As a result, the wellbore pressure drops, as illustrated by segment 128 of FIG. 10. The pressure drop is due to the shorter friction path followed by the returning slurry fluid which now travels between screen 32 and conduit 38 to the first valve assembly 52 and is returned through the first valve assembly 52 rather than through open end 48 of conduit 38.

Figure 11:
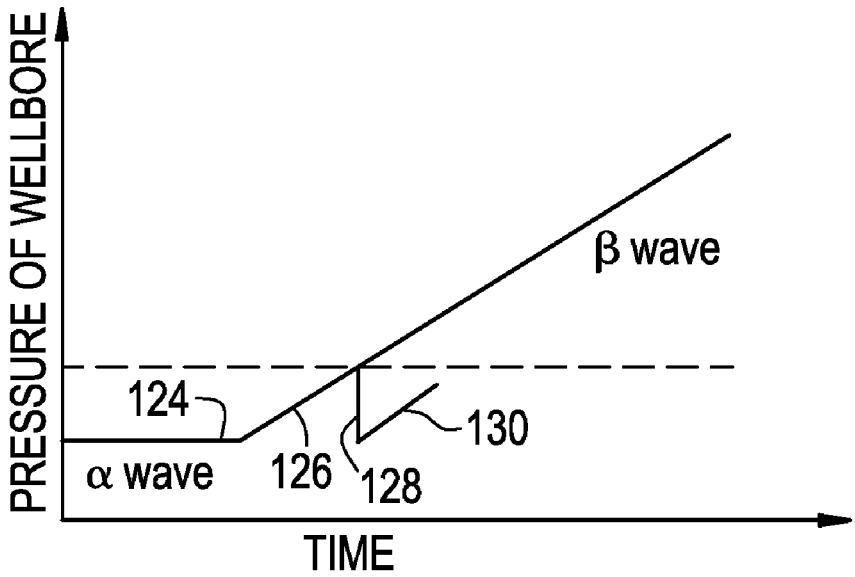
FIG. 11 is a view similar to that in FIG. 10, but showing the resumption of pressure build up after the first pressure relief valve is opened, according to an embodiment of the present invention.
Figure 12:
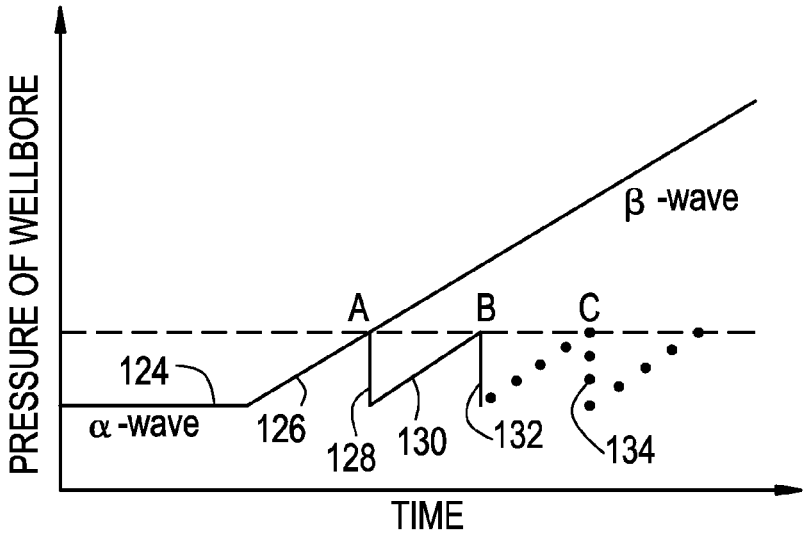
FIG. 12 is a view similar to that in FIG. 10, but showing the relief of wellbore pressure as subsequent pressure relief valves are opened, according to an embodiment of the present invention

As the gravel packing operation proceeds and the beta wave 58 continues to move along the wellbore, wellbore pressure again begins to rise as indicated by segment 130 in FIG. 11. Once the wellbore pressure again rises to a point at or near the fracture pressure of the formation, the second valve assembly 52 (see point B in FIG. 1) is actuated. As a result, the wellbore pressure again drops, as illustrated by segment 132 of FIG. 12. The pressure drop is due to the still shorter friction path followed by the returning slurry fluid which now travels between screen 32 and conduit 38 to the second valve assembly 52 and is returned through the second valve assembly 52 rather than through open end 48 or the first valve assembly 52. This wellbore pressure reduction process can be repeated with each subsequent valve assembly, as indicated by the dashed line segment 134 of FIG. 12.

Figure 13:
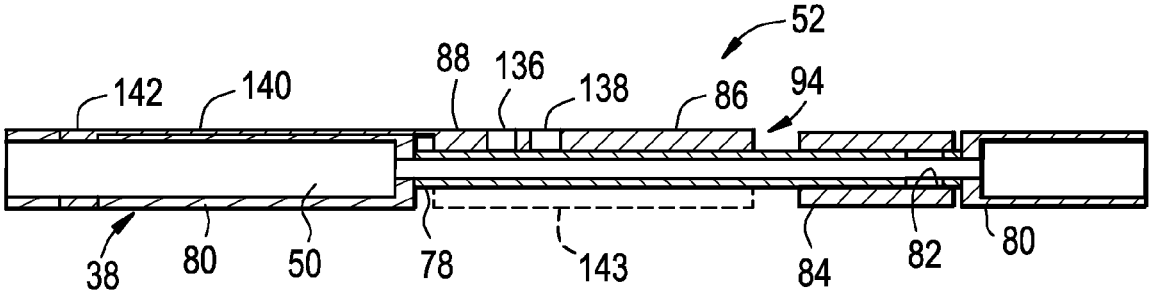
FIG. 13 is a schematic illustration of a section of conduit having a valve for relieving wellbore pressure, according to an alternate embodiment of the present invention.

An alternate embodiment of wellbore assembly 52 and its control system is illustrated in FIG. 13. In this embodiment, conduit 38 again comprises narrow diameter section 78 disposed longitudinally between larger diameter sections 80. One or more openings/ports 82 extend through the wall of narrow diameter section 78 for fluid communication with interior passage 50. Valve assembly 52 is coupled to conduit 38 and comprises, for example, valve 84, e.g. a sliding sleeve valve, actuator 86, and an intelligent electronics section 88. If valve 84 comprises a sliding sleeve valve, actuation of that valve can be accomplished as described above with reference to FIGS. 6-9. In the present embodiment, electronics section 88 has a different configuration and utilizes a pair of pressure sensors 136 and 138 to selectively control valve assembly 52. The valve assembly 52 also may comprise at least one pressure conduit 140 and a conduit termination 142 positioned at a desired pressure detection location. A pressure conduit 140 can be coupled to each sensor 136, 138 or to one of the sensors to detect pressure at a location separated from the actual sensor. It should be noted that in this embodiment and the other embodiments described herein, a redundant electronics section 143 can be used in each valve assembly 52 to provide added dependability.

Figure 5:
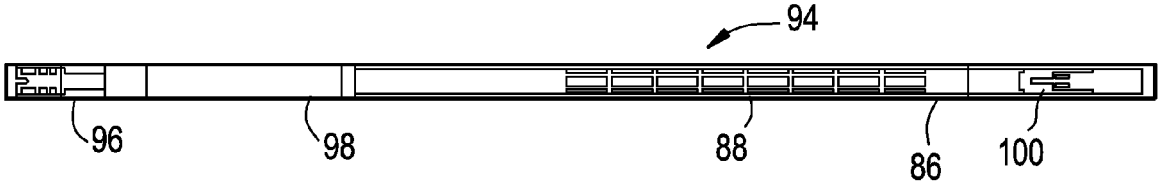
FIG. 5 is a view illustrating an actuator used to actuate one of the pressure relief valves, according to an embodiment of the present invention.
Figure 14:
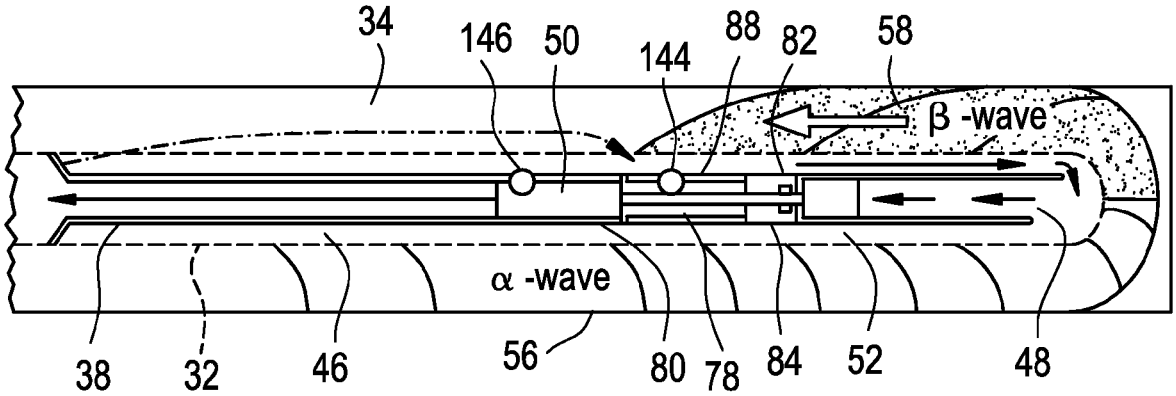
FIG. 14 is a view of the valve illustrated in FIG. 13 deployed in cooperation with a conduit used in a gravel packing procedure, according to an embodiment of the present invention.

As illustrated in FIG. 14, the pressure sensors 136, 138 are used to sense pressure at two different locations, such as at first location 144 in the vicinity of the corresponding valve assembly 52 and at a location 146 sufficiently upstream. In one embodiment, pressure is sensed at a distance of 30 feet or more upstream, however this distance can be less in other applications. As with the embodiment illustrated in FIGS. 4 and 5, electronics can be in the form of a microprocessor based controller. However, the embodiment illustrated in FIGS. 13 and 14 relies on electronics configured/programmed to recognize predetermined pressure profiles detected by sensors 136, 138. Upon recognizing the predetermined pressure profile, the electronics section 88 actuates valve 84 to open the valve and allow flow of exterior fluids into interior passage 50, as described above.

Figure 15:
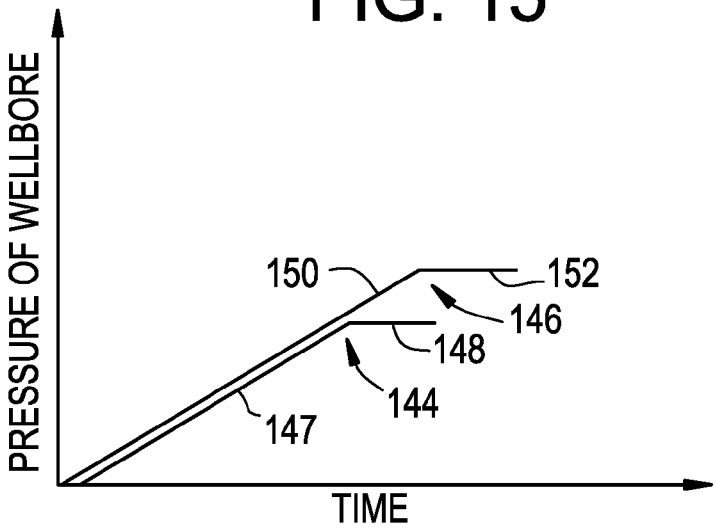
FIG. 15 is a graphical representation of a predetermined pressure profile detected by a pair of pressure sensors and used to determine the appropriate time for opening a corresponding pressure relief valve.

One example of a suitable predetermined pressure profile is provided with reference to FIG. 15. As illustrated, each of the sensors 136, 138 detects a rise in wellbore pressure, as indicated by graph segment 147. As the beta wave 58 passes over the first sensing location 144, the pressure detected by sensor 136 flattens out as indicated by graph segment 148. However, the wellbore pressure detected at sensing location 146 via sensor 138 continues to rise, as indicated by graph segment 150. When the beta wave 58 passes over sensing location 146, the wellbore pressure detected by sensor 138 also flattens out as indicated by graph segment 152. Once this pressure profile is determined by controller 88, actuation of the valve assembly is initiated.

Accordingly, a microprocessor based intelligent electronics section 88 can be programmed to detect a specific sequence of events or pressure profile as follows:

a.) Initially, the wellbore pressure detected at both location 144 and location 146 is increasing (see FIG. 15, graph segment 147);

b.) subsequent to a.), the wellbore pressure detected at location 144 forms a plateau while the wellbore pressure detected at location 146 continues to increase;

c.) subsequent to b.), the wellbore pressure detected at location 146 forms a plateau.

Once these three conditions are met in the right sequence, the microprocessor based controller 88 recognizes the predetermined pressure profile and sends the appropriate command to open valve 84. If more than one valve assembly 52 is deployed along conduit 38, each valve assembly 52 can be constructed similarly to recognize a predetermined pressure profile and to open a flow path based on detection of that predetermined pressure profile.

In general, the gravel packing systems described herein can be constructed with a greater or lesser number of valve assemblies than those illustrated, depending on the length of the desired gravel pack and other formation or well equipment parameters. Furthermore, the gravel packing systems can be constructed for compatibility with subsequent fluid pumping or flow operations without affecting the dependable, accurate annulus wellbore pressure reduction capability of the pressure relief system.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for controlling pressure in a wellbore annulus while gravel packing, comprising:

a conduit positioned in an isolated lower wellbore region, the conduit having an internal passageway;

at least one valve assembly positioned along the conduit to selectively admit fluid from the isolated lower wellbore region into the internal passageway; and an electromagnetic telemetry system operatively coupled to the at least one valve assembly, the electromagnetic telemetry system being able to selectively open the at least one valve assembly via electromagnetic signals sent through the earth from a surface location.

2. The system as recited in claim 1, wherein the at least one valve assembly comprises a plurality of valve assemblies.

3. The system as recited in claim 1, wherein the conduit comprises a wash pipe that is isolated by a packer, the system further comprising a sand screen positioned around the wash pipe.

4. The system as recited in claim 2, wherein each valve assembly of the plurality of valve assemblies comprises a sliding sleeve valve for selectively opening a flow path into the internal passageway.

5. The system as recited in claim 4, wherein the sliding sleeve valve of each valve assembly is initially held in a closed position by a trapped fluid.

6. The system as recited in claim 5, wherein each valve assembly further comprises at least one atmospheric chamber into which the trapped fluid may be released to enable actuation of the sliding sleeve valve.

7. The system as recited in claim 1, wherein the at least one valve assembly comprises at least one inlet opening that may be selectively opened to allow the flow of fluid from the isolated lower wellbore region into the internal passageway, each inlet opening having a one-way check valve.

8. The system as recited in claim 1, wherein the at least one valve assembly comprises an electronics unit to decode a measured voltage difference between two reference points to determine whether the valve assembly should be actuated to an open position.

9. The system as recited in claim 8, wherein the at least one valve assembly comprises redundant electronics units.

10. The system as recited in claim 1, further comprising at least one pressure sensor to measure a downhole pressure profile, wherein downhole pressure profile data is sent to the surface via the electromagnetic telemetry system.

11. The system as recited in claim 10, wherein the at least one valve assembly is activated via the electromagnetic telemetry system based on the downhole pressure profile data processed at the surface.

12. A method to reduce wellbore pressure during gravel packing operations, comprising:

isolating a conduit within a wellbore region to be gravel packed;

deploying a plurality of valve assemblies along the conduit to selectively admit fluid into the conduit to relieve pressure during gravel packing; and coupling an electromagnetic telemetry system to the plurality of valve assemblies to enable selective opening of an individual valve assembly of the plurality of valve assemblies by sending electromagnetic signals from a surface location.

13. The method as recited in claim 12, further comprising gravel packing the wellbore region.

14. The method as recited in claim 12, further comprising decoding the electromagnetic signals by measuring a voltage difference between two reference points associated with each valve assembly.

15. The method as recited in claim 14, further comprising locating the two reference points on the conduit and using a conductor coupled between the two reference points and a valve electronics section.

16. A system for controlling pressure in a wellbore annulus while gravel packing, comprising:

a conduit positioned in an isolated lower wellbore region, the conduit having an internal passageway;

at least one valve assembly positioned along the conduit to selectively admit fluid from the isolated lower wellbore region into the internal passageway; and an intelligent electronic system using at least two pressure sensors, the intelligent electronics system being operatively coupled to the at least one valve assembly to selectively open the at least one valve assembly when a predetermined pressure profile is detected by the at least two pressure sensors.

17. The system as recited in claim 16, wherein the at least two pressure sensors comprise a first pressure sensor to sense pressure in the vicinity of a valve assembly of the at least one valve assembly and a second pressure sensor to sense pressure in a position upstream of the first pressure sensor, upstream being relative to the flow of an alpha wave of the gravel pack.

18. The system as recited in claim 17, wherein the predetermined pressure profile comprises a pressure rise for both the first sensor and the second sensor followed by a pressure plateau for the first sensor and a subsequent pressure plateau for the second sensor.

19. The system as recited in claim 17, further comprising a pressure conduit to conduct pressure from the position upstream to the intelligent electronic system.

20. The system as recited in claim 16, wherein the at least one valve assembly comprises a plurality of valve assemblies.

21. The well system as recited in claim 20, wherein each valve assembly comprises a sliding sleeve valve for selectively opening a flow path into the internal passageway.

22. The well system as recited in claim 21, wherein the sliding sleeve valve of each valve assembly is initially held in a closed position by a trapped fluid.

23. The well system as recited in claim 22, wherein each valve assembly further comprises at least one atmospheric chamber into which the trapped fluid may be released to enable movement of the sliding sleeve valve.

24. The well system as recited in claim 16, wherein the at least one valve assembly comprises at least one inlet opening that may be selectively opened to allow the flow of fluid from the isolated lower wellbore region into the internal passageway, each inlet opening having a one-way check valve.

25. A method to reduce wellbore pressure during gravel packing operations, comprising:

isolating a conduit within a welibore region to be gravel packed;

deploying a plurality of valve assemblies along the conduit to selectively admit fluid into the conduit to relieve pressure during gravel packing; and coupling an intelligent electronic system to the plurality of valve assemblies to enable the selective opening of individual valve assemblies of the plurality of valve assemblies based on predetermined pressure profiles detected via at least two pressure sensors associated with each valve assembly.

26. The method as recited in claim 25, further comprising gravel packing the wellbore region.

27. The method as recited in claim 25, further comprising selecting a pressure profile for the at least two pressure sensors that comprises simultaneous pressure increases at a first pressure sensor and a second pressure sensor, followed by a pressure plateau at the first sensor and a subsequent pressure plateau at the second sensor.

28. A method, comprising:

providing a conduit positioned in an isolated lower wellbore region, the conduit having an internal passageway;

providing at least one valve assembly positioned along the conduit to selectively admit fluid from the isolated lower wellbore region into the internal passageway;

providing an electromagnetic telemetry system operatively coupled to the at least one valve assembly, the electromagnetic telemetry system being able to selectively open the at least one valve assembly via electromagnetic signals sent through the earth from a surface location; and executing a well related procedure utilizing a flow of fluid through the conduit.

29. The method as recited in claim 28, wherein executing comprises executing a gravel packing procedure in which a gravel slurry fluid is routed through the at least one valve.

30. The method as recited in claim 28, wherein providing a conduit comprises providing the conduit into a deviated well.

31. The method as recited in claim 28, wherein providing at least one valve assembly comprises providing a plurality of valve assemblies positioned along the conduit.

32. The method as recited in claim 28, further comprising constructing the at least one valve with a plurality of seated members that can be unseated by flow of fluid in a first direction.

* * * * *